United States Patent [19]

Jachna

[11] 3,944,484

[45] Mar. 16, 1976

[54] STRUCTURAL SUPPORTS FOR HEAVY DUTY RIDDLE ASSEMBLY

[75] Inventor: Waclaw Jachna, Tychy, Poland

[73] Assignee: Centralny Osrodek Projektowo-Technologiczny Przemyslu Maszyn Gorniczych "ORTEM", Katowice, Poland

[22] Filed: Feb. 22, 1974

[21] Appl. No.: 444,804

Related U.S. Application Data

[63] Continuation-in-part of Ser. No. 402,578, Oct. 1, 1973, abandoned, which is a continuation of Ser. No. 110,123, Jan. 27, 1971, abandoned.

[30] Foreign Application Priority Data

Feb. 6, 1970 Poland ..... 138661

[52] U.S. Cl. ..... 209/409; 209/363

[51] Int. Cl. ..... B07b 1/46

[58] Field of Search ..... 209/409, 405, 326, 313, 209/408, 412, 329, 319, 363, 364

[56] References Cited

UNITED STATES PATENTS

| | | | |
|---|---|---|---|
| 249,056 | 11/1881 | Jebb | 209/313 |
| 703,887 | 7/1902 | Anderson | 209/313 |
| 1,125,762 | 1/1915 | Sturterant | 209/405 |
| 1,459,844 | 6/1923 | Mitchell | 209/326 |
| 2,003,923 | 6/1935 | Clausen | 209/405 |
| 2,274,701 | 3/1942 | Jenks | 209/408 |
| 2,777,579 | 1/1957 | Roubol | 209/412 |
| 3,070,231 | 12/1962 | McCorhel | 209/319 |
| 3,308,952 | 3/1967 | Parks | 209/329 |

*Primary Examiner*—Robert Halper
*Attorney, Agent, or Firm*—Karl F. Ross; Herbert Dubno

[57] ABSTRACT

A riddle assembly for the grading of particulate materials has a pair of screens forming respective screening stages and disposed one above another. Each of the stages is formed by a pair of longitudinally extending rails interconnected by longitudinally spaced transverse rails having multispan configuration with a pair of outer spans projecting laterally outwardly beyond the longitudinal rails and an inner span interconnecting the two rails and disposed between them. The multispan transverse beams are of nonuniform cross-section corresponding to the distribution of stresses whereby each beam is of uniform strength.

5 Claims, 7 Drawing Figures

FIG. 1
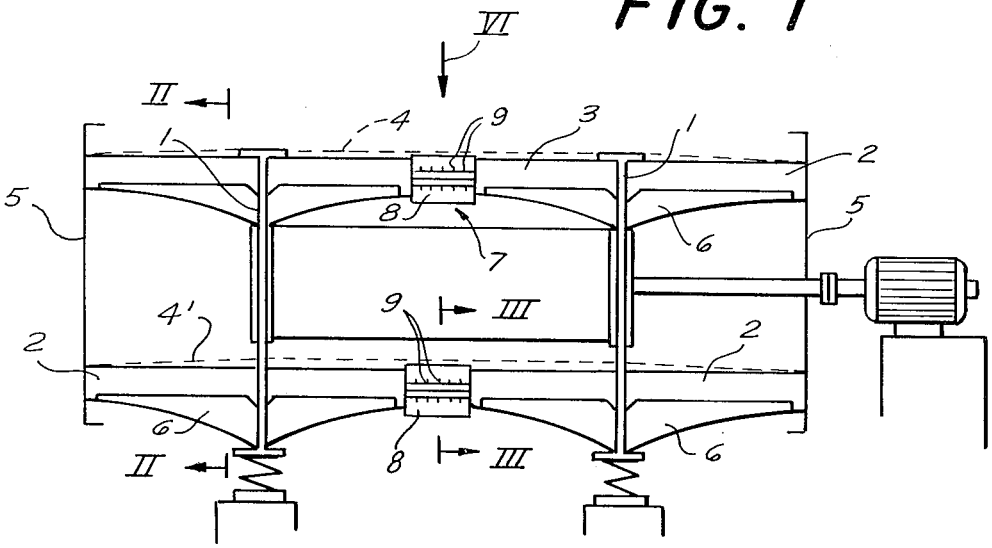
FIG. 2
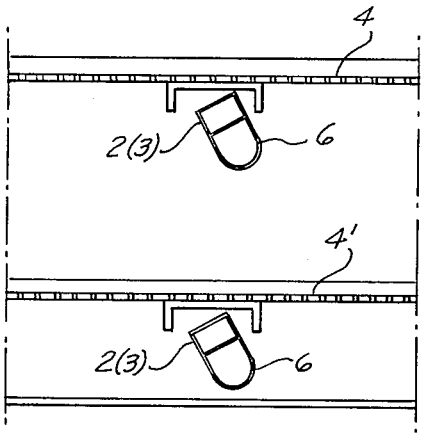
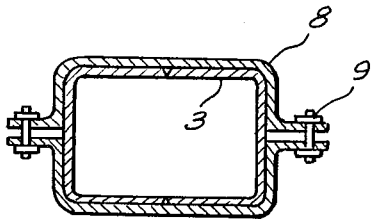
FIG. 3
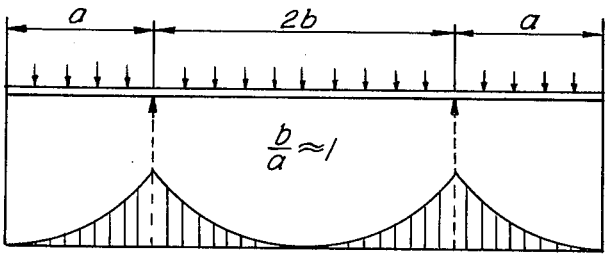
FIG. 5

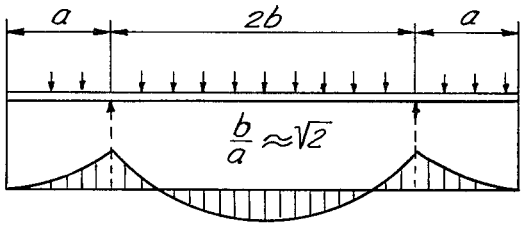
FIG. 4
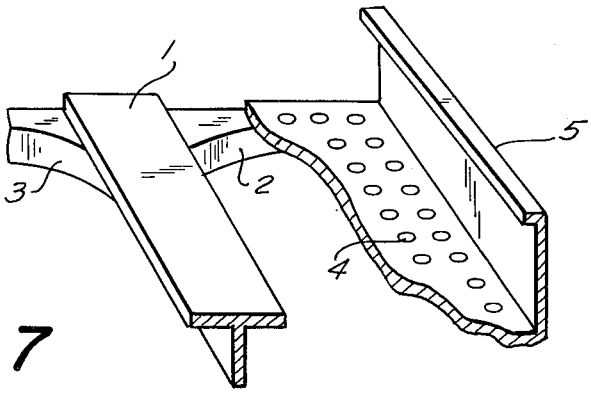
FIG. 7
FIG. 6
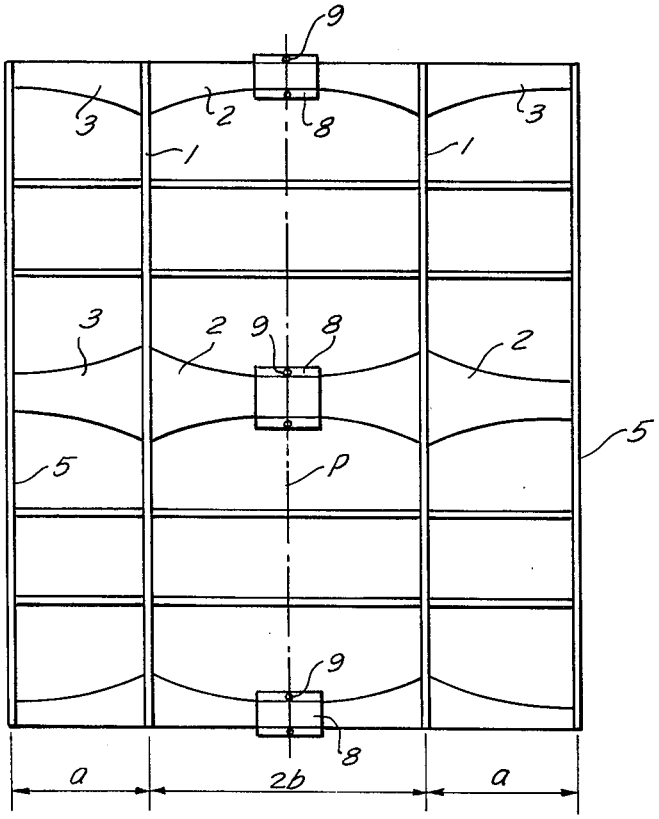

STRUCTURAL SUPPORTS FOR HEAVY DUTY RIDDLE ASSEMBLY

CROSS-REFERENCE TO RELATED APPLICATIONS

This application is a continuation-in-part of my copending but now abandoned patent application Ser. No. 402,578 filed Oct. 1, 1973 as a continuation of my patent application Ser. No. 110,123 filed Jan. 27, 1971 and now abandoned.

FIELD OF THE INVENTION

The present invention relates to a riddle or sieve used for grading fluent solids. More particularly this invention concerns a support for the screening surface in an industrial heavy-duty screening machine.

BACKGROUND OF THE INVENTION

A riddle assembly, be it of the single or multiple deck type, must be of relatively large surface area if it is to be used commercially with a high degree of efficiency. Use of several small-capacity screening arrangements is expensive and generally wasteful.

Certain design problems are encountered when it is attempted to build large-capacity screening devices. It has been found virtually impossible to build such a device having a width greater than 3 meters. Such devices, become with increased size, so massive and heavy that shaking or vibrating the screens requires an enormous drive and the resonant frequency of the large screen support approaches the shaking frequency and leads to recurrent breakdowns.

In one known riddle of extended width the sieve is supported on at least two longitudinal and symmetrically aligned carrying members interconnected by multispan cross beams. In such a device the riddle or sieve is vibrated by means of a drive affixed directly to the longitudinal carrying members. This riddle rests on elastic elements on the supporting structure.

A fundamental feature which makes this described construction different from conventional constructions is the outer spans which are the elements extending the riddle width. These outer spans are made in tubular form with a uniform section, selected in proportion to the value of maximum bending moments.

Such construction does not reduce the weight of the installation by much, this reduction being very important in the case of riddles of considerable width which are vibrated by means of a drive whose size and power demand depend mainly on the mass of the entire system.

The middle and outer spans in such a large-width riddle assembly are usually the same. Such an arrangement facilitates replacing of sieves in separate sections.

Mounting of riddle vibrators either directly on a carrying box-section member or above this member divides the screening surface into independent sections parallel to the direction of motion of the sieved material. This offers an additional difficulty for the sieving process since a uniform distribution of the material over the entire sieve area becomes impossible, thus reducing the efficiency of the process.

OBJECTS OF THE INVENTION

It is therefore an object of the present invention to provide an improved riddle assembly.

Another object is the provision of a large-size screening apparatus which is extremely rugged but of relatively light construction.

A further object is to provide an improved screen or riddle support which is light in weight but very strong.

SUMMARY OF THE INVENTION

These objects are attained according to the present invention in an apparatus wherein the lateral carrying members are made in the form of multispan beams of a uniform strength. The cross section of these beams is nonuniform and selected according to the stresses occurring locally in different sections of the beam. This has been achieved by application of supports fixed to the lateral beams, which therefore form a uniform and rigid element of nonuniform section. Middle spans linking the longitudinal carrying members have their minimum cross sections in the symmetry line of the riddle assembly, the cross sections increasing toward the locations where the spans are fixed to the carrying longitudinal walls or beams.

The outer spans, on the other hand, have their minimum cross sectons at their free ends, these cross sections increasing inwardly toward the locations where the spans are fixed to the inner longitudinal walls. Due to such a construction a high rigidity of the structure and a considerable weight reduction in this structure are achieved.

In accordance with yet another feature of the present invention the length of the outer spans of the cross beams forms a ratio to the length of the inner spans of these cross beams which lies between 0.5/1 and $0.5/\sqrt{2}$. Thus with an overall transverse width of 2 meters, for example, between the longitudinal walls, the outer cantilevered spans of the cross beams have lengths of between 0.71 meter and 1.0 meter, giving the entire assembly an overall width between 3.42 meters and 4.0 meters. These proportions have proven themselves to be surprisingly efficient, since the mass per unit screening surface increases disproportionately when this range is not followed.

Such construction has been found to be fully operational because tapered cross beams are found to have a higher natural resonant frequency than beams of similar length and uniform cross section. Tests have shown that the resonant frequency of a sample support beam having a given length and a uniform cross section of 10 cm × 10 cm to be 4.3 times lower than the resonant frequency of a beam made according to the present invention with similar supporting strength, that is tapering down from a cross section of 10 cm × 20 cm to its end, and that the weight of the beam according to this invention is substantially less. What is more the beams according to the present invention are stressed substantially less than prior-art uniform-section beams, and therefore stress their supporting structures less at the point of attachment.

In the above-mentioned case the bending moment in the mid part of the middle span is approximately zero. This makes it possible to divide the riddle apparatus into two parts along the line of symmetry where the stresses are at their minimum, such a division facilitating the transport and the assembly of the apparatus while retaining a high rigidity and structural strength.

The present invention enables that screens can be built with riddles practically twice as wide as has been hitherto possible. At the same time, owing to application of cross beams having uniform strength, a lower consumption of materials per surface unit of the riddle can be obtained, while the fact that the longitudinal supporting walls are built below of the sieve deck allows a uniform distribution of the worked material over the entire area of the sieve.

The division of the riddle along its central symmetry plane where the bending moments are at their minimum is advantageous from the point of view of transport of large units as well as of easy assembly at the site of a riddle consisting of two or more parts. In accordance with another feature of this invention clamping means is provided for so joining two such parts.

DESCRIPTION OF THE DRAWING

The above and other objects, features, and advantages will become more readily apparent from the following with reference to the accompanying drawing in which:

FIG. 1 is a cross section through a riddle apparatus according to the present inventon;

FIG. 2 is a longitudinal section taken along II—II of FIG. 1;

FIG. 3 is a longitudinal section taken along line III—III of FIG. 1, in enlarged scale;

FIGS. 4 and 5 are schematic representations of the loading of the cross beams of the apparatus according to this invention;

FIG. 6 is a view taken in the direction of arrow VI of FIG. 1 with the screen removed; and FIG. 7 is a perspective view of a corner of the apparatus of FIG. 1, with parts broken away for clarity of view.

SPECIFIC DESCRIPTION

A riddle as shown in FIGS. 1, 5 and 6 consists of two inner walls 1 running in parallel to the center plane P of the screen, with transverse beams 2, 3, 2 fixed in these walls 1 and supporting sieve decks 4 and $4^1$ together with material to be graded (not shown). The transverse beams 2, 3, 2 are made in the form of three spans: a middle span 3 fixed between and perpendicular to the walls 1, and outer spans 2 terminating in parallel protecting plates 5. Welded to the transverse beams 2, 3, 2 are buttressing gusset sections 6 (FIG. 2) whose nonuniform cross sections are selected in proportion to the value of the local bending moments according to the principle of design of beams of uniform strength. The spans 2, 3, 2 together with supporting sections 6 form a unit of nonuniform cross section, the middle span 3 having its smallest cross section in the plane P of riddle symmetry, the outer spans 2 having their smallest cross sections at the points where they meet protecting plates 5. These cross sections grow, in both cases, toward the ends where the spans are fixed in the inner supporting walls 1.

In the symmetry plane P of the riddle, the middle spans 3 are split and their free ends are connected together by means of couplings 7 made in the form of two clamping rings 8 bolted together with bolts 9 as shown in FIG. 3. The inner walls 1 are installed below the top sieve deck 4 so that a uniform spreading of the material to be screened over the entire sieve area is possible.

FIG. 4 illustrates the loading of transverse beams 2, 3, 2. The ratio of the middle span half length $b$ to the length $a$ of the outer spans is: $b/a = \sqrt{2}$ and the absolute value of bending moments acting in the axis of longitudinal walls 1 is the same as that of the bending moment occurring in the mid part of the middle span beam. The values of these moments are half those in the case of conventional riddles with two outer walls.

FIG. 5 shows the loading of transverse beams 2, 3, 2, when the ratio of the middle span half length $b$ to the length $a'$ of outer spans is: $b/a = 1$.

In the above described case the bending moment in the symmetry plane P in the center of the middle span 3 is zero.

I claim:

1. A riddle assembly comprising:

a pair of longitudinally extending outer vertical plates;

a pair of transversely spaced longitudinally extending inner walls disposed between said plates and parallel to a longitudinal plane spaced midway between said inner walls;

a sieve deck overlying said inner walls and having longitudinal edges projecting laterally beyond said walls, said screen being bisected by said plane and flanked by said outer plates;

a plurality of transverse beams extending parallel to one another and spaced along and secured to said inner walls, each of said beams having a central span of predetermined length disposed between and interconnecting said inner walls and projecting laterally therefrom, said spans being of nonuniform cross section increasing toward said inner walls proportional to the bending moments along said beams whereby said transverse beams have uniform strength along their full length, and each of said outer spans being at the most half as long as the respective central spans.

2. The riddle assembly defined in claim 1 wherein each of said central spans comprises a pair of tubular portions, said assembly further comprising respective clamping means for releasably locking said tubular portions of each of said central spans together at said plane.

3. The riddle assembly defined in claim 1 wherein the ratio of the half length $b$ of each central span to the length $a$ of each outer span of each of the transverse beams is in the ratio of substantially $b/a = \sqrt{2}$.

4. The riddle assembly defined in claim 1 wherein the ratio of the half length $b$ of the central span to the length $a$ of each outer span of each transverse beam is substantially $b/a = 1$.

5. The riddle assembly defined in claim 1 wherein said walls lie in respective vertical planes and have upper portions fixed to said transverse beams and said sieve deck, and lower portions extending below said sieve deck, said riddle assembly further comprising a plurality of mutually parallel further transverse beams interconnecting said lower portions of said walls and spaced longitudinally therealong, said further transverse beams having central spans interconnecting said inner walls and outwardly projecting outer spans cantilevered on said inner walls, said outer plates being to the free ends of said transverse beams on both sides of said assembly, said further transverse beams carrying a lower sieve deck.

* * * * *